US009732551B2

(12) United States Patent
George et al.

(10) Patent No.: US 9,732,551 B2
(45) **Date of Patent: *Aug. 15, 2017**

(54) MOVABLE PARTITION SYSTEMS, PANEL ASSEMBLIES, AND METHODS OF ATTACHING PROTECTIVE CLIPS TO PANELS OF MOVABLE PARTITIONS

(71) Applicant: Won-Door Corporation, Salt Lake City, UT (US)

(72) Inventors: Michael D. George, Kaysville, UT (US); William Michael Coleman, Salt Lake City, UT (US)

(73) Assignee: Won-Door Corporation, Salt Lake City, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/200,691

(22) Filed: Jul. 1, 2016

(65) Prior Publication Data

US 2016/0312522 A1 Oct. 27, 2016

Related U.S. Application Data

(63) Continuation of application No. 13/734,814, filed on Jan. 4, 2013, now Pat. No. 9,382,749.

(51) Int. Cl.

| | |
|---|---|
| ***E04B 1/346*** | (2006.01) |
| ***E06B 3/48*** | (2006.01) |
| ***E05D 15/06*** | (2006.01) |

(52) U.S. Cl.

CPC ..... *E06B 3/481* (2013.01); *E05D 15/0626* (2013.01)

(58) Field of Classification Search

CPC ..... E04B 2/827; E06B 3/481; E06B 3/4618; E06B 9/262; E05Y 2900/106; E05Y 2900/132; E05D 15/24; F16L 5/04; A47H 13/01

USPC ..... 52/64, 232, 207, 213; 160/84.02, 188, 160/194, 197, 198

See application file for complete search history.

(56) References Cited

U.S. PATENT DOCUMENTS

| | | | |
|---|---|---|---|
| 2,892,496 | A | 6/1959 | Stroup |
| 2,970,642 | A | 2/1961 | Parsons |
| 2,994,371 | A | 8/1961 | Morseth et al. |

(Continued)

OTHER PUBLICATIONS

Office Action dated Jan. 26, 2012 in U.S. Appl. No. 12/423,502, filed Apr. 14, 2009, by George et al., 12 pages.

(Continued)

*Primary Examiner* — Charles A. Fox
*Assistant Examiner* — James Buckle, Jr.
(74) *Attorney, Agent, or Firm* — TraskBritt

(57) ABSTRACT

Panel assemblies for movable partitions include a panel and a protective clip covering at least a portion of a bottom surface of the panel. The panel includes channels defined between lateral edge portions and a back side surface of the panel. Tabs of the protective clip are positioned within corresponding channels. Movable partitions include at least one panel and at least one protective clip, which is assembled with the at least one panel and is coupled to a back side surface of the at least one panel. Tabs of the back portion of the at least one protective clip are inserted at least partially within two opposing channels of the at least one panel. Methods of attaching a protective clip to a panel of a movable partition include positioning tabs extending from longitudinal ends of the back portion of the protective clip within channels of the panel.

20 Claims, 9 Drawing Sheets

(56) References Cited

U.S. PATENT DOCUMENTS

| | | | |
|---|---|---|---|
| 3,205,935 | A | 9/1965 | Cayton |
| 3,234,996 | A | 2/1966 | King |
| 3,380,506 | A | 4/1968 | Good |
| 3,672,424 | A | 6/1972 | Brown |
| 3,854,246 | A | 12/1974 | McAllister |
| 3,955,330 | A | 5/1976 | Wendt |
| 3,994,330 | A | 11/1976 | Laby |
| 4,055,917 | A | 11/1977 | Coller |
| 4,235,049 | A | 11/1980 | Marinoni et al. |
| 4,357,979 | A | 11/1982 | Marontate |
| 4,446,332 | A | 5/1984 | Dauser, Jr. |
| 4,545,148 | A | 10/1985 | Shaw |
| 4,922,987 | A | 5/1990 | Marontate et al. |
| 5,199,478 | A | 4/1993 | Kubota |
| 5,237,776 | A | 8/1993 | Kubota |
| 5,401,091 | A | 3/1995 | Landry |
| 5,465,532 | A | 11/1995 | Varin |
| 6,026,611 | A | 2/2000 | Ralston et al. |
| 6,253,493 | B1 | 7/2001 | Sauve |
| 6,269,591 | B1 | 8/2001 | Kelly |
| 6,332,294 | B1 | 12/2001 | Carranza |
| 6,371,188 | B1 | 4/2002 | Baczuk et al. |
| 6,397,522 | B1 | 6/2002 | Nussbaum |
| 7,003,916 | B2 | 2/2006 | Nestell et al. |
| 7,062,881 | B2 | 6/2006 | Rissone |
| 7,427,096 | B2 | 9/2008 | Snider et al. |
| 7,584,574 | B2 | 9/2009 | Kinross et al. |
| 8,297,334 | B2 | 10/2012 | Chu |
| 8,739,472 | B2 | 6/2014 | Moss |
| 2007/0151179 | A1 | 7/2007 | Speyer et al. |
| 2007/0175121 | A1 | 8/2007 | Speyer et al. |
| 2007/0234657 | A1 | 10/2007 | Speyer et al. |
| 2010/0257793 | A1 | 10/2010 | George et al. |
| 2011/0203746 | A1 | 8/2011 | Smart |
| 2012/0138242 | A1 | 6/2012 | Kondash et al. |

OTHER PUBLICATIONS

Office Action dated Mar. 22, 2012 in U.S. Appl. No. 13/294,621, filed Nov. 11, 2011, by George et al., 19 pages.
Office Action dated Mar. 26, 2012 in U.S. Appl. No. 13/294,641, filed Nov. 11, 2011, by George et al., 21 pages.
Office Action dated Feb. 3, 2011 in U.S. Appl. No. 12/423,502, filed Apr. 14, 2009, by George et al., 11 pages.
Office Action dated May 2, 2014 in U.S. Appl. No. 12/423,502, filed Apr. 14, 2009, by George et al., 12 pages.
Office Action dated May 21, 2013 in U.S. Appl. No. 12/423,502, filed Apr. 14, 2009, by George et al., 18 pages.
Office Action dated Jun. 28, 2012 in U.S. Appl. No. 12/423,502, filed Apr. 14, 2009 by George et al., 19 pages.
Office Action dated Jul. 22, 2011 in U.S. Appl. No. 12/423,502, filed Apr. 14, 2009, by George et al., 14 pages.
Office Action dated Aug. 17, 2012 in U.S. Appl. No. 13/294,641, filed Nov. 11, 2011, by George et al., 23 pages.
Office Action dated Aug. 22, 2012 in U.S. Appl. No. 13/294,621, filed Nov. 11, 2011, by George et al., 22 pages.
Office Action dated Nov. 6, 2014 in U.S. Appl. No. 13/294,621, filed Nov. 11, 2011, by George et al., 31 pages.
Office Action dated Nov. 6, 2014 in U.S. Appl. No. 13/294,641, filed Nov. 11, 2011, by George et al., 32 pages.
Office Action dated Oct. 2, 2013 in U.S. Appl. No. 12/423,502, filed Apr. 14, 2009, by George et al., 18 pages.
Office Action dated Dec. 19, 2012 in U.S. Appl. No. 12/423,502, filed Apr. 14, 2009, by George et al., 18 pages.

MOVABLE PARTITION SYSTEMS, PANEL ASSEMBLIES, AND METHODS OF ATTACHING PROTECTIVE CLIPS TO PANELS OF MOVABLE PARTITIONS

CROSS-REFERENCE TO RELATED APPLICATIONS

This application is a continuation of U.S. patent application Ser. No. 13/734,814, filed Jan. 4, 2013, now U.S. Pat. No. 9,382,749, issued Jul. 5, 2016. The subject matter of this application is related to the subject matter of U.S. patent application Ser. No. 12/423,502, titled "PROTECTIVE CLIPS FOR MOVABLE PARTITIONS, MOVABLE PARTITIONS INCLUDING SUCH PROTECTIVE CLIPS, AND METHODS OF FORMING SUCH PROTECTIVE CLIPS," filed Apr. 14, 2009, abandoned. The subject matter of this application is related to the subject matter of U.S. patent application Ser. No. 13/294,641, titled "MOVABLE PARTITIONS AND PROTECTIVE CLIPS FOR MOVABLE PARTITIONS," filed Nov. 11, 2011, now U.S. Pat. No. 9,068,392, issued Jun. 30, 2015, which is a divisional of U.S. patent application Ser. No. 12/423,502. The subject matter of this application is related to the subject matter of U.S. patent application Ser. No. 13/294,621, titled "METHODS OF FORMING PROTECTIVE CLIPS FOR MOVABLE PARTITIONS AND METHODS OF INSTALLING PROTECTIVE CLIPS FOR MOVABLE PARTITIONS," filed Nov. 11, 2011, now U.S. Pat. No. 9,074,412, issued Jul. 7, 2015, which is a continuation of U.S. patent application Ser. No. 12/423,502. The disclosure of each of these applications is hereby incorporated by reference herein. The subject matter of this application is also related to the subject matter of U.S. patent application Ser. No. 14/789,210, titled "PROTECTIVE CLIPS FOR MOVABLE PARTITIONS AND RELATED METHODS," filed Jul. 1, 2015, which is a divisional of U.S. patent application Ser. No. 13/294,621.

TECHNICAL FIELD

Embodiments of the present disclosure relate to movable partitions that may be used to partition a relatively larger space into two or more relatively smaller spaces, to panel assemblies for such movable partitions, and to methods of making and using such movable partitions and panel assemblies.

BACKGROUND

Movable partitions are utilized in numerous situations and environments for a variety of purposes. Such partitions may include, for example, a movable partition comprising foldable or collapsible doors configured to enclose or subdivide a room or other area. Often such partitions may be utilized simply for purposes of versatility in being able to subdivide a single large room into multiple smaller rooms. The subdivision of a larger area may be desired, for example, to accommodate multiple groups or meetings simultaneously. In other applications, such partitions may be utilized for noise control depending, for example, on the activities taking place in a given room or portion thereof.

Movable partitions may also be used to provide a security and/or fire barrier. In such cases, the partition barrier may be configured to automatically close upon the occurrence of a predetermined event such as the actuation of an associated alarm. For example, one or more accordion or similar folding-type partitions may be used as a security and/or a fire barrier wherein each partition is formed with a plurality of panels connected to one another with hinges. The hinged connection of the panels allows the partition to fold and collapse into a compact unit for purposes of storage when not deployed. Thus, the partition may be stored, for example, in a pocket formed in a wall of a building when in a retracted or folded state. When deployment of the partition is required to subdivide a single large room into multiple smaller rooms, secure an area during a fire, or for any other specified reason, the partition may be deployed along a track, which is often located above the door in a header, until the partition extends a desired distance across the room.

In some applications, it is desirable to provide a seal along the peripheral edges of the movable partition to improve the efficacy of the partition as one or more of a visual barrier, a noise barrier, a barrier to smoke or fire, a climate barrier, and a security barrier. For example, it is known to attach a strip of polymer material to the bottom of a movable partition such that the polymer material extends between the lower edge of the movable partition and the surface of the floor below the movable partition. The strip of polymer material is attached to the lower edge of the movable partition and is sized and configured to contact the surface of the floor, but is not attached to the floor. Thus, as the movable partition is moved relative to the floor, the strip of polymer material sweeps across the surface of the floor. As a result, those in the art often refer to such strips of polymer material as a "sweep" or a "sweep strip."

It is known to attach a sweep strip to the lower edge of a movable partition using a plurality of clips, which are often referred to in the art as "sweep clips." For example, on partitions that include a plurality of panels attached to one another by hinges, a clip may be attached to the lower end of each panel, and the sweep strip may be attached to each of a plurality of the sweep clips. Each sweep clip may be provided with a feature (e.g., a channel) having a geometry that is complementary to the geometry of a feature (e.g., a bead) provided on the sweep strip. Thus, the features on a plurality of sweep clips may be engaged with the complementary feature on the sweep strip to attach the sweep strip to the sweep clips and, hence, to the lower edge of the movable partition.

It is also known to use the sweep clips as protective clips to cover the lower ends of the panels of the movable partition. The panels may be formed of a material, such as metal, that exhibits a tendency to have sharp edges and corners, which may injure a person's feet or ankles that contact the sharp edges or corners of the panels. Thus, it is known to provide sweep clips with a protective guard portion to cover such sharp edges or corners of the panels. Such sweep clips are attached to panels of the movable partition by abutting the sweep clip against a bottom of the panel and fastening the sweep clip to the panel using, for example, a rivet.

BRIEF SUMMARY

In one embodiment, the present disclosure includes panel assemblies for movable partitions including a panel and a protective clip. The panel includes a front side surface, a bottom surface, a back side surface, a hinge retainer extending along each lateral side of the panel, a lateral edge portion proximate each hinge retainer, and a channel defined between each lateral edge portion and the back side surface. The protective clip covers at least a portion of the bottom surface of the panel. The protective clip includes a base member abutted against the bottom surface of the panel and a back portion abutted against the back side surface of the panel. The back portion of the protective clip includes two tabs. Each of the two tabs is positioned within a corresponding channel of the panel and is abutted against a corresponding lateral edge portion of the panel.

In another embodiment, the present disclosure includes movable partitions including at least one panel and at least one protective clip. The at least one panel includes a front side surface, a back side surface, a bottom surface, and two lateral edge portions defining two opposing channels between the lateral edge portions and the back side surface. The at least one protective clip includes a base portion and a back portion protruding from the base portion, the back portion including a tab at each longitudinal end thereof. Each tab is sized to fit at least partially within a channel of the two opposing channels of the at least one panel. The at least one protective clip is assembled with the at least one panel to at least partially cover the bottom surface of the at least one panel with the base portion. The back portion of the at least one protective clip abuts against the back side surface of the at least one panel. The tabs of the back portion of the at least one protective clip are inserted at least partially within the two opposing channels of the at least one panel.

In yet another embodiment, the present disclosure includes methods of attaching a protective clip to a panel of a movable partition. In accordance with such methods, a base portion of a protective clip is abutted against a bottom surface of a panel. A back portion of the protective clip protruding from the base portion is abutted against a back side surface of the panel. A tab extending from a longitudinal end of the back portion is positioned at least partially within a channel defined between the back side surface of the panel and a lateral edge portion of the panel. Another tab extending from another longitudinal end of the back portion is positioned at least partially within another channel defined between the back side surface of the panel and another lateral edge portion of the panel.

DETAILED DESCRIPTION

Illustrations presented herein are not meant to be actual views of any particular device or system, but are merely idealized representations that are employed to describe embodiments of the present disclosure. Additionally, elements common or similar between figures may retain the same numerical designation.

As used herein, the term "substantially," in reference to a given parameter, property, or condition, means to a degree that one of ordinary skill in the art would understand that the given parameter, property, or condition is met within a degree of variance, such as within acceptable manufacturing tolerances.

As used herein, any relational term, such as "first," "second," "top," "bottom," etc., is used for clarity and convenience in understanding the disclosure and accompanying drawings and does not connote or depend on any specific preference, orientation, or order, except where the context clearly indicates otherwise.

Embodiments of the present disclosure include panel assemblies for a movable partition including protective clips coupled with respective panels. Each of the protective clips may include a back portion with two tabs that are each positioned within a channel of the respective panel. The channels of the panel may each be defined between a lateral edge portion of the panel and a back side surface of the panel. Each tab may be coupled to (e.g., abut against) an inner surface of the lateral edge portion of the panel within the channel. The back portion of the protective clip between the two tabs may be coupled to (e.g., abut against) the back side surface of the panel. Thus, the protective clip and the panel are configured such that, when assembled, there is mechanical interference between the tabs of the protective clip and the lateral edge portions of the panel defining the channels to hold the protective clip in place relative to the panel.

Figure 1:
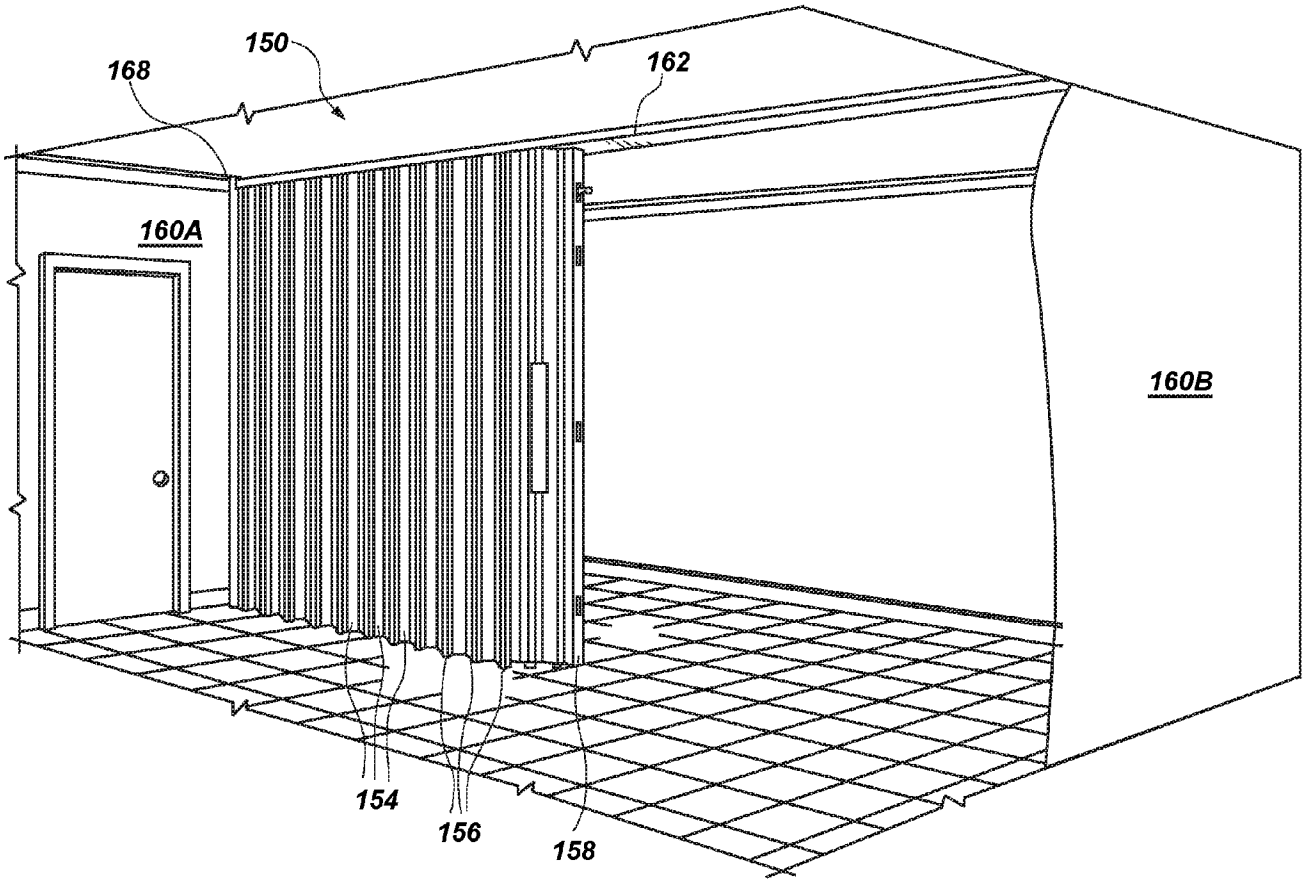
FIG. 1 is a perspective view of a movable partition that includes at least one protective clip in accordance with embodiments of the present disclosure.

FIG. 1 is a perspective view of a movable partition 150 that includes a plurality of protective clips according to embodiments of the present disclosure. As shown in FIG. 1, the movable partition 150 includes a plurality of generally rigid panels 154 that are coupled together in accordion fashion using flexible (e.g., polymeric) hinge members 156. In other embodiments, the hinge members 156 may comprise metal hinge members. In yet further embodiments, the panels 154 may be directly coupled to one another in a hinged configuration, and there may not be any discrete hinge member 156 between the directly adjoining panels 154. The movable partition 150 is coupled to (e.g., suspended from) an overhead track 162 along which the movable partition 150 moves as the movable partition 150 is expanded (i.e., closed) and retracted (i.e., opened).

The movable partition 150 may be used, for example, to subdivide a relatively larger space into relatively smaller spaces (e.g., rooms or areas). In other embodiments, the movable partition 150 may be used as a barrier (e.g., a security barrier, a noise barrier, and/or a fire barrier). The hinged connection of the panels 154 allows the movable partition 150 to be compactly stored in a pocket 168 formed in a wall 160A of a building, if desirable, when in a retracted or folded state.

To deploy the movable partition 150 to an extended position, the movable partition 150 is moved along the overhead track 162. A leading edge of the movable partition 150 may include a lead post 158 configured to engage with a door jamb or another post, which may be provided in a wall 160B of a building to which the movable partition 150 may extend in an extended state. The movable partition 150 may be an accordion-type door that includes two generally parallel sides each formed by hingedly coupled panels 154, with a space between the two generally parallel sides. The space may be provided as an additional sound barrier or fire barrier, for example. As used herein, the term "front" generally refers to an outer portion of the movable partition 150 (or a component thereof) that is exposed when the movable partition 150 is assembled and installed in a building, while the term "back" generally refers to an inner portion of the movable partition 150 (or a component thereof) that is within or faces the space between the generally parallel sides of the movable partition 150.

A protective clip of the present disclosure may be coupled to a bottom of each panel 154, as will be explained in more detail below. While the embodiment of the movable partition 150 shown and described with reference to FIG. 1 contains a single accordion-type door, additional embodiments of the present invention may include multiple doors. For example, a partition may include two doors (e.g., accordion-type doors) configured to extend across a space and join together to partition a space.

An embodiment of a protective clip 110 of the present disclosure is shown in FIGS. 2 through 7. Referring to FIGS. 2 through 7, the protective clip 110 includes an elongated and generally planar base portion 112, a guard portion 126 protruding from the base portion 112, and a back portion 134 protruding from the base portion 112. Each of the guard portion 126 and the back portion 134 may protrude from a top major surface 114 of the base portion 112 in a direction substantially perpendicular to the base portion 112.

The base portion 112 of the protective clip 110 includes the top major surface 114, a bottom major surface 116, a front side surface 118, a back side surface 120, a first end side surface 122, and a second end side surface 124. The first end side surface 122 is disposed at a first longitudinal end of the protective clip 110, and the second end side surface 124 is disposed at an opposite, second longitudinal end of the protective clip 110. A majority of each of the first and second end side surfaces 122 and 124 may, in some embodiments, be substantially planar and extend substantially perpendicular to the front side surface 118 of the protective clip 110. The base portion 112 may be sized and shaped to be coupled to (e.g., abut against) and cover at least a portion (e.g., at least a substantial portion) of a bottom surface of a panel 154 of the movable partition 150 (FIG. 1). Thus, a length of the base portion 112 may be selected based on a lateral width of a corresponding panel 154 to which the protective clip 110 is to be coupled. By way of example and not limitation, the base portion 112 may have a length that is from about 4.4 inches (about 11.2 cm) to about 4.75 inches (about 12.1 cm) to substantially cover a bottom surface of a panel 154 having a lateral width of about 4.5 inches (about 11.4 cm), a length that is about 7.4 inches (about 18.8 cm) to about 7.75 inches (about 19.7 cm) to substantially cover a bottom surface of a panel 154 having a lateral width of about 7.5 inches (about 19.1 cm), and a length that is about 9.9 inches (about 25.1 cm) to about 10.25 inches (about 26.0 cm) to substantially cover a bottom surface of a panel 154 having a lateral width of about 10 inches (about 25.4 cm).

Figure 2:
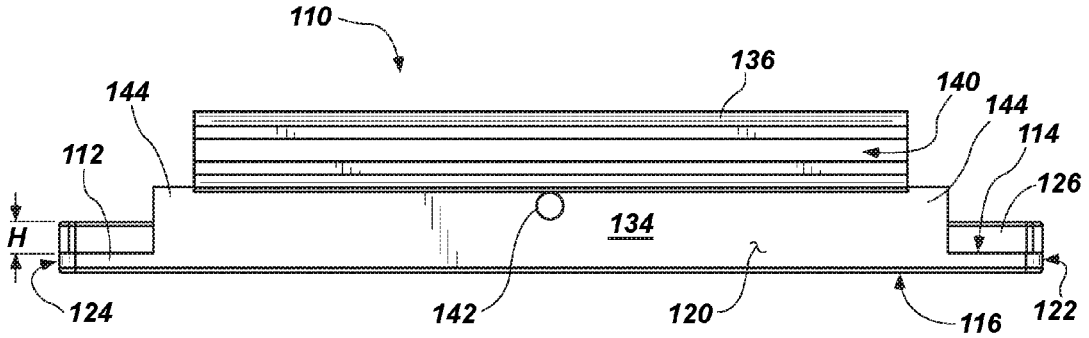
FIG. 2 is a back view of a protective clip in accordance with embodiments of the present disclosure.
Figure 4:
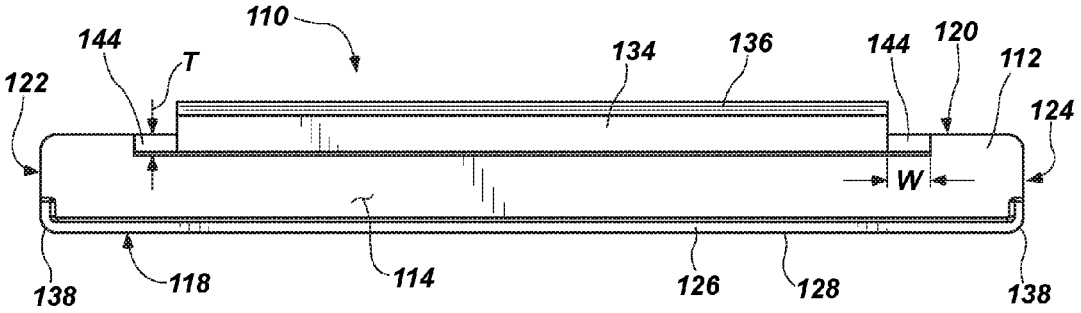
FIG. 4 is a top view of the protective clip of FIG. 2.
Figure 5:
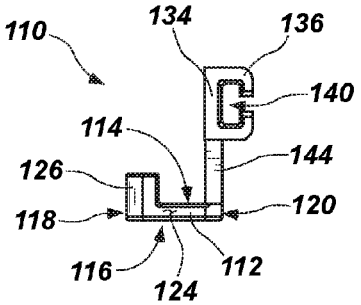
FIG. 5 is a side view of the protective clip of FIG. 2.
Figure 7:
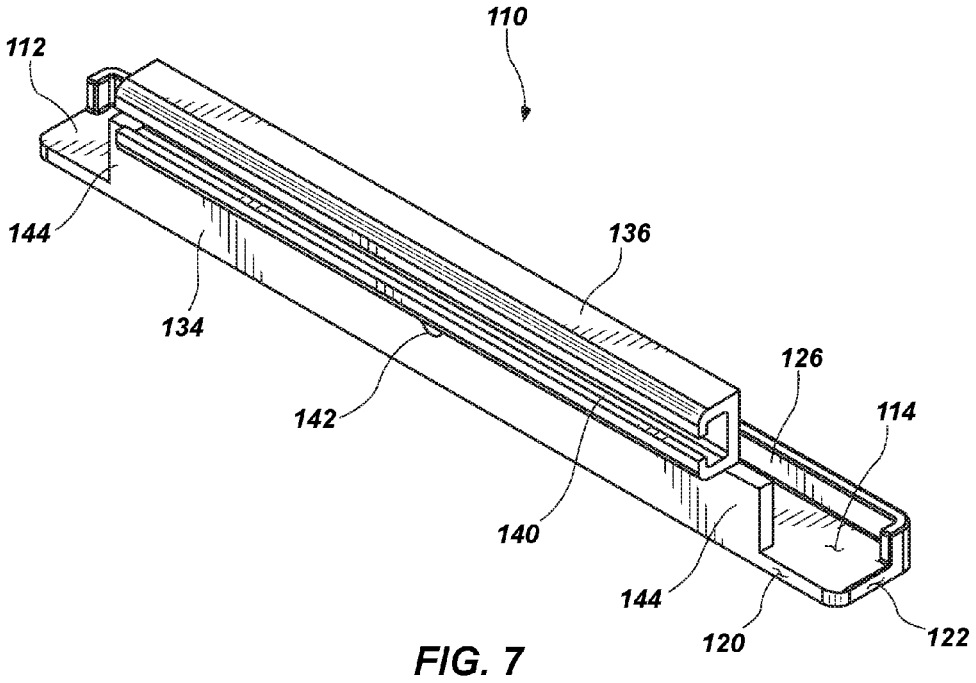
FIG. 7 is a perspective view of a back of the protective clip of FIG. 2.

The protective clip 110 includes a back portion 134 that may extend from the base portion 112 proximate the back side surface 120 thereof. In some embodiments, a surface of the back portion 134 may be substantially coplanar with the back side surface 120 of the base portion 112, as shown in FIGS. 2, 5, and 7. The back portion 134 may extend along the top major surface 114 proximate at least a section of the back side surface 120 of the base portion 112. The back portion 134 may be configured for attaching the protective clip 110 to a panel of a movable partition. For example, the back portion 134 may include a tab 144 extending from each longitudinal end thereof for insertion within a channel formed on an associated panel, as will be explained in more detail below. Each tab 144 may be sized (e.g., may have a thickness T and a width W (FIG. 4)) to fit at least partially within such a channel to mechanically stabilize the protective clip 110 with respect to the associated panel. By way of example and not limitation, the thickness T of the tabs 144 may be between about 0.05 inch (about 0.13 cm) and about 0.1 inch (about 0.254 cm), and the width W of each tab 144 may be between about 0.1 inch (about 0.254 cm) and about 0.25 inch (about 0.635 cm).

The tabs 144 may simply be an extension of the back portion 134. Thus, the back portion 134 may have a thickness proximate the tabs 144 (e.g., between the base portion 112 and the attachment feature 136 (FIG. 2)) that is substantially equivalent to the thickness T of the tabs 144. In addition, the back portion 134 of the protective clip 110 may include a hole 142 for attaching the protective clip 110 to a panel 154 of the movable partition 150 (FIG. 1) using a fastener, such as a rivet, a screw, or a bolt. In some embodiments, no more than one hole 142 and no more than one fastener may be used for attaching the protective clip 110 to a panel 154, since the tabs 144 provide mechanical stability for the protective clip 110 relative to the panel 154. Accordingly, stabilizing the protective clip 110 with multiple holes 142 and multiple fasteners, which would require additional time and expense to manufacture and/or assemble, may not be necessary in some embodiments of the present disclosure. In additional embodiments, the back portion 134 of the protective clip 110 may be attached to the panel 154 of the movable partition 150 using an adhesive.

As shown in FIGS. 2, 5, and 7, the back portion 134 may be configured for attachment of a sweep strip 170 (FIGS. 14 and 15) thereto. For example, the back portion 134 may include an attachment feature 136 for attaching a sweep strip to the protective clip 110. The feature 136 may be configured to engage with a complementary feature on the sweep strip 170 and may be used to attach the sweep strip 170 to the protective clip 110. For example, the attachment feature 136 may comprise one or more protrusions extending from the back portion 134 that define a channel 140 therebetween that extends longitudinally along the back portion 134 from one tab 144 to an opposite tab 144. The channel 140 may have a T-shaped cross-sectional geometry (see FIG. 5).

Figure 3:
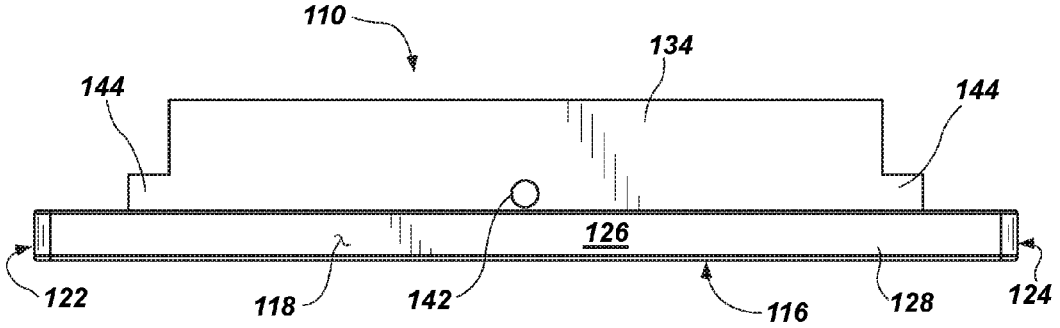
FIG. 3 is a front view of the protective clip of FIG. 2.
Figure 6:
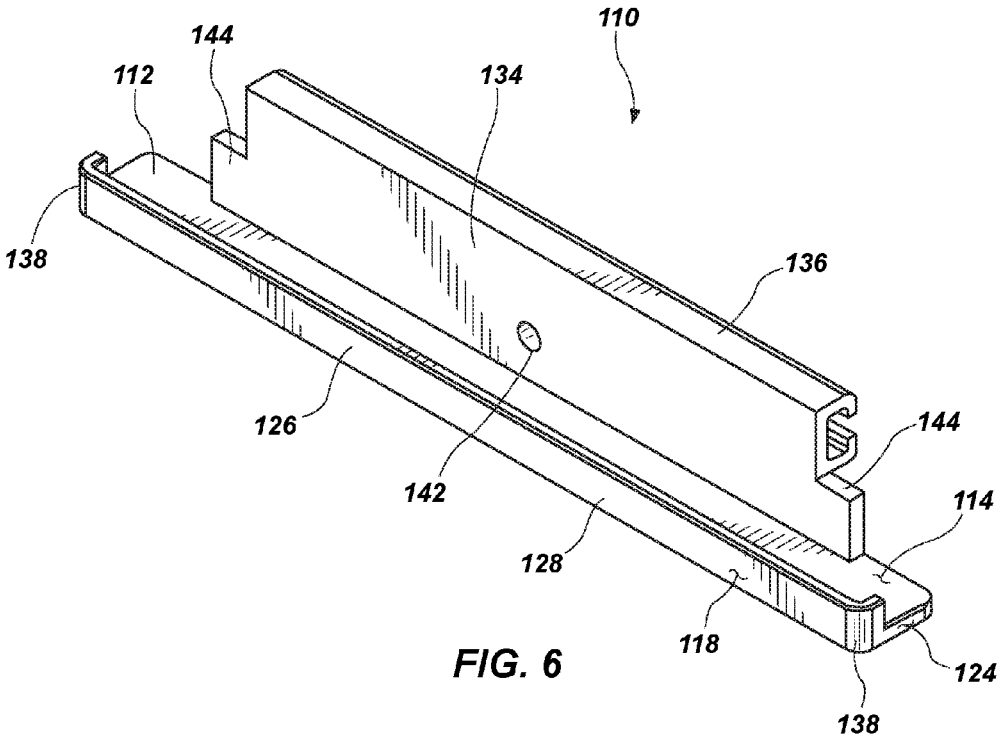
FIG. 6 is a perspective view of a front of the protective clip of FIG. 2.

The guard portion 126 of the protective clip 110 may be configured to guard or protect one or more corners and/or edges of a panel to which the protective clip 110 is attached, as discussed in further detail below. As shown in FIG. 2, the guard portion 126 may extend to a height H from the top major surface 114 of the base portion 112 sufficient to cover the one or more corners and/or edges of an associated panel. By way of non-limiting example, the height H of the guard portion 126 may be between about one sixteenth of an inch (about 1.6 mm) and about one quarter of an inch (about 6.4 mm), such as about one eighth of an inch (about 3.2 mm). As shown in FIGS. 3, 4, and 6, the guard portion 126 may be configured as a rail that extends along the top major surface 114 proximate (e.g., adjacent) the front side surface 118 of the base portion 112, around corners 138 of the base portion 112, and along the top major surface 114 proximate (e.g., adjacent) the first end side surface 122 and the second end side surface 124 of the base portion 112. In some embodiments, a surface of the guard portion 126 may be substantially coplanar with the front side surface 118 of the base portion 112. In other words, the guard portion 126 may extend along at least a section of a peripheral edge 128 of the top major surface 114. The guard portion 126 may extend along the peripheral edge 128 of the top major surface 114 adjacent a portion of the first end side surface 122, around a corner 138, adjacent the front side surface 118, around another corner 138, and adjacent a portion of the second end side surface 124.

In some embodiments, the guard portion 126 may extend along only a portion of the first end side surface 122 and along only a portion of the second end side surface 124, while another portion of the first and second end side surfaces 122 and 124 is free of the guard portion 126, to provide clearance for a hinge member extending between adjacent panels, as will be explained in more detail below.

Edges and corners of the protective clip 110 may be rounded (e.g., radiused). For example, the corners 138 (FIG. 4) between the front side surface 118 and each of the first end side surface 122 and the second end side surface 124 may be rounded to a radius of between about 0.075 inch (about 1.9 mm) and about one eighth of an inch (about 3.2 mm). By rounding the corners 138, injuries that might occur when the foot of a person contacts or rubs against a corner 138 may be reduced or substantially eliminated.

The protective clip 110 may be manufactured from and comprise materials such as polymeric materials, composite materials, and metal materials. As non-limiting examples, the protective clip 110 may be manufactured from and comprise a polymeric material such as an acrylonitrile butadiene styrene (ABS) material or a polyvinyl chloride (PVC) material. Such polymeric materials also may include a filler material such as, for example, glass particles (e.g., whiskers). In additional embodiments, the protective clip 110 may comprise a metal material such as, for example, aluminum, an aluminum-based alloy material, iron, or an iron-based alloy material.

The protective clip 110 shown in FIGS. 2 through 7 may be manufactured using a molding process such as, for example, an injection molding process. In an injection molding process, a mold may be formed that includes a mold cavity having a geometry complementary to that of the protective clip 110 such that the protective clip 110 may be formed by injecting material into the mold cavity. The mold may comprise a plurality of mold parts (e.g., two mold halves), and recesses may be formed into the adjoining surfaces of the mold parts such that the mold cavity is defined by the recess surfaces in the various mold parts when they are assembled together. The mold cavity may be shaped to form a protective clip 110. In other words, the mold cavity within the mold may be shaped to include a portion corresponding to the base portion 112, another portion corresponding to the guard portion 126, and another portion corresponding to the back portion 134 of the protective clip 110. After shaping the mold cavity, material (e.g., a molten polymer material) may be injected into the mold cavity to form the protective clip 110. Injection molding systems suitable for use in forming embodiments of protective clips 110 of the present disclosure are commercially available. Of course, the protective clip 110 of the present disclosure is not limited to being formed by injection molding. One of ordinary skill in the art will be capable of forming the protective clip 110 using other techniques, such as machining, compression molding, casting, 3D printing, or a combination thereof, for example.

Figure 8:
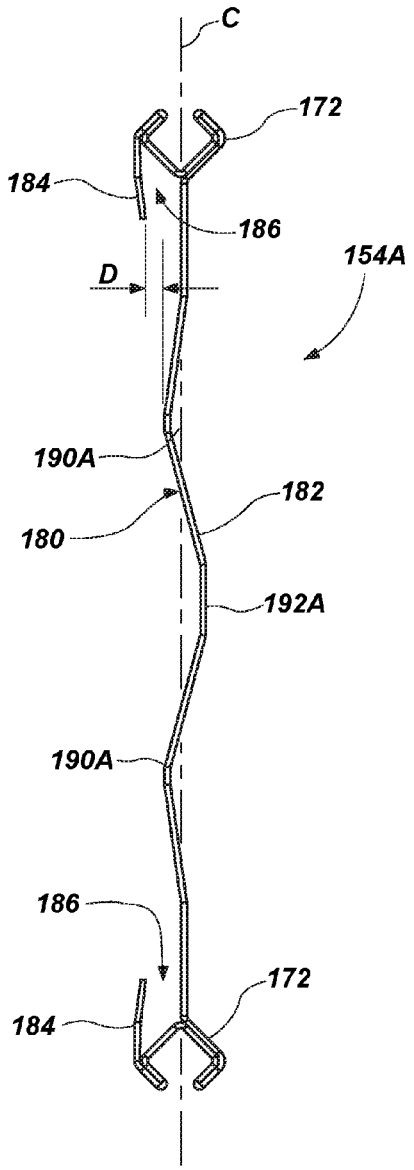
FIG. 8 is a top view of a panel of a movable partition in accordance with embodiments of the present disclosure.
Figure 9:
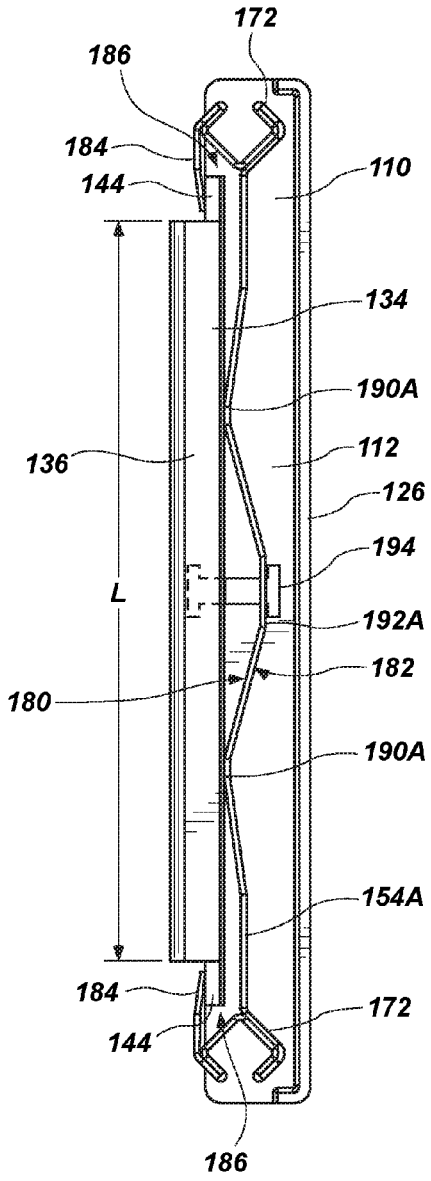
FIG. 9 is a top view of the panel of FIG. 8 assembled with a protective clip in accordance with embodiments of the present disclosure.
Figure 10:
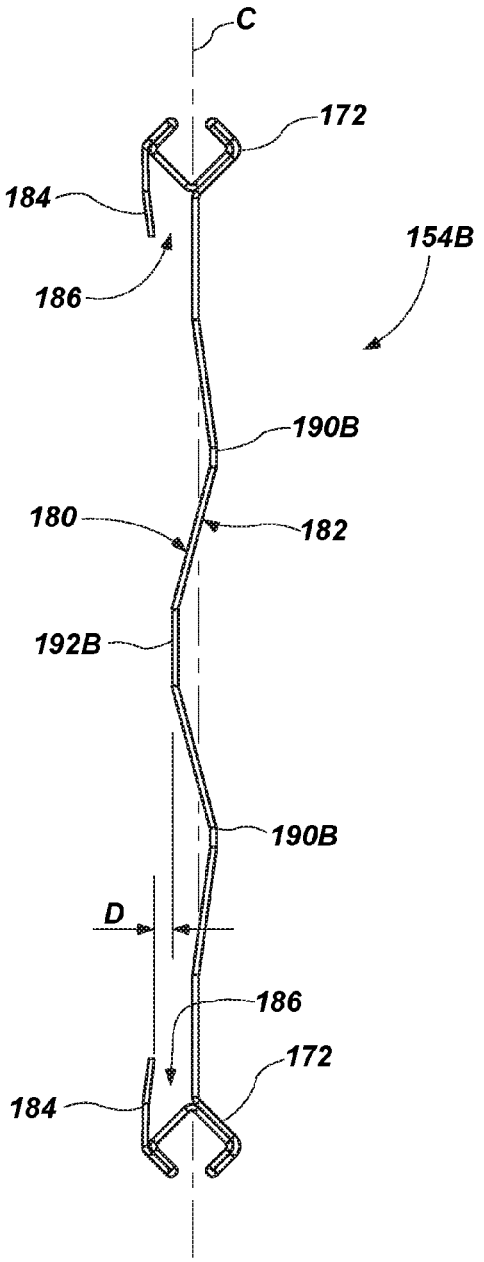
FIG. 10 is a top view of another panel in accordance with embodiments of the present disclosure.
Figure 11:
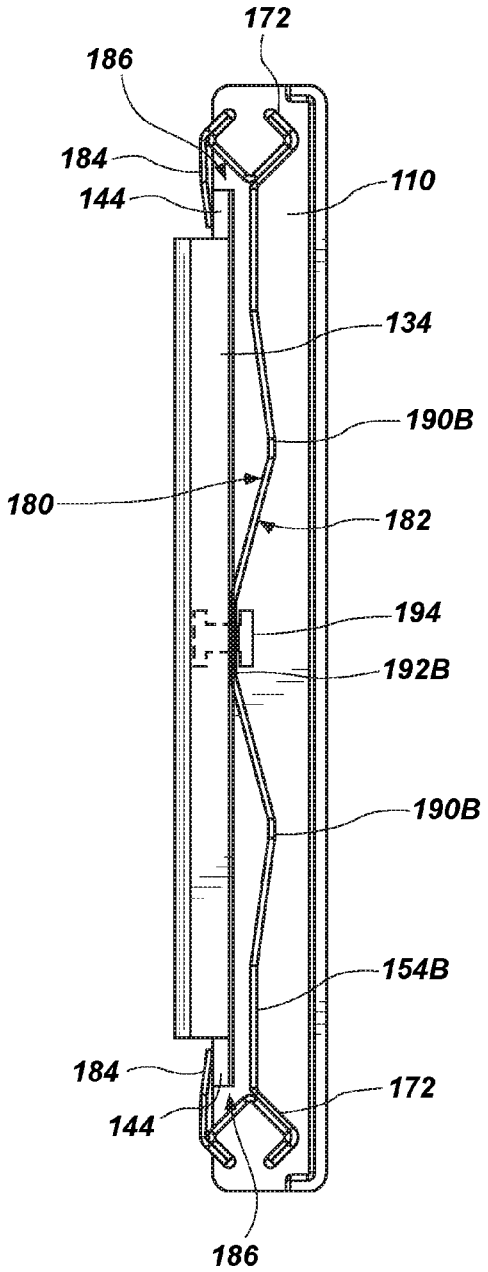
FIG. 11 is a top view of the panel of FIG. 10 assembled with a protective clip in accordance with embodiments of the present disclosure.

FIGS. 8 and 10 illustrate cross-sectional views of two configurations of a panel (respectively numbered 154A and 154B) to which the protective clip 110 of FIGS. 2 through 7 may be attached, as shown in FIGS. 9 and 11, respectively. Referring to FIG. 8, the panel 154A may include a hinge retainer 172 extending along each lateral side of the panel 154A to receive a portion (e.g., a bead) of a hinge member for connecting adjacent panels 154A, as will be explained in more detail below. The panel 154A may have a back side surface 180 and a front side surface 182. Lateral edge portions 184 (e.g., flanges) may extend generally along the back side surface 180 proximate the hinge retainers 172 to define channels 186 between the lateral edge portions 184 and the back side surface 180 of the panel 154A. The opposing lateral edge portions 184 may extend from the respective hinge retainers 172 generally toward a central region of the panel 154A. The lateral edge portions 184 may be provided in the panel 154A to secure a liner, such as an insulating material, to the panel 154A with a liner clip, as is known in the art. In addition, the lateral edge portions 184 may be used to couple the protective clip 110 to the panel 154A by inserting the tabs 144 into the channels 186 defined by the lateral edge portions 184, as will be explained in more detail below.

As shown in FIG. 8, the panel 154A may include two ridges or protrusions 190A that extend from a central plane C of the panel 154A toward a back side of the panel 154A and one central ridge or protrusion 192A that extends from the central plane C of the panel 154A toward a front side of the panel 154A. The ridges or protrusions 190A and 192A may be provided in the panel 154A for various reasons. For example, the ridges or protrusions 190A and 192A may strengthen the panel 154A against bending or other damage that may result from impact against the panel 154A. In addition, the central ridge or protrusion 192A may accommodate a structural member of the partition that supports (e.g., suspends) the panel 154A from a roller coupled to the overhead track 162 (FIG. 1) at a top portion of the panel 154A when installed in a building. The central ridge or protrusion 192A may include a hole therethrough corresponding to the hole 142 (FIGS. 2, 3, 6, and 7) of the protective clip 110 for attaching the protective clip 110 to the panel 154A with a fastener 194 (e.g., a rivet, a screw, a bolt, etc.) (FIG. 9), which may prevent the protective clip 110 from sliding off of and detaching from the panel 154A. As noted above, in some embodiments, no more than one fastener 194 may be used to hold the protective clip 110 on the panel 154A.

The two ridges or protrusions 190A may also be used to couple the panel 154A to the back portion 134 of the protective clip 110 when the protective clip 110 is assembled with the panel 154A, as shown in FIG. 9. By way of example and not limitation, the back portion 134 may abut against the two ridges or protrusions 190A. A distance D (FIG. 8) between each of the two ridges or protrusions 190A extending toward a back side of the panel 154A and an inner surface of an associated lateral edge portion 184 of the panel 154A, taken perpendicular to the central plane C of the panel 154A, may be related to the thickness T (FIG. 4) of the back portion 134 of the protective clip 110. For example, as shown in FIG. 9, the protective clip 110 may be assembled with the panel 154A by inserting the tabs 144 thereof into the channels 186 of the panel 154A and coupling the back portion 134 of the protective clip 110 to at least one of the two ridges or protrusions 190A of the panel 154A on the back side surface 180 of the panel 154A. By way of example and not limitation, the back portion 134 of the protective clip 110 may be abutted against the at least one of the two ridges or protrusions 190A of the panel 154A. Thus, in some embodiments, the distance D may be at least substantially equal to or less than the thickness T of the back portion 134 of the protective clip 110. In some embodiments, the distance D may be less than the thickness T of the back portion 134 of the protective clip 110, since one or both of the back portion 134 of the protective clip 110 and the panel 154A may slightly bend or flex during assembly of the protective clip 110 with the panel 154A. Such bending or flexing may ensure that the back portion 134 of the protective clip 110 is coupled to (e.g., abuts against) at least one of the two ridges or protrusions 190A of the panel 154A and that the tabs 144 of the protective clip 110 are coupled to the lateral edge portions 184 of the panel 154A within the channels 186. Thus, mechanical interference between the back portion 134 of the protective clip 110 and the panel 154A may improve stability of the protective clip 110 relative to the panel 154A compared to prior known protective clips or sweep clips that are assembled with panels in a different manner (e.g., using one or more fasteners alone).

Although the fastener 194 is shown in FIG. 9 as extending through the central ridge or protrusion 192A, the present disclosure is not so limited. Since the fastener 194 may be used to prevent the protective clip 110 from sliding off and detaching from the panel 154A and additional stability may be provided by the tabs 144 coupled to the lateral edge portions 184, the fastener 194 may be positioned at any convenient location along the panel 154A and protective clip 110. For example, in some embodiments, the fastener 194 may extend through a hole in one of the two ridges or protrusions 190A of the panel 154A coupled to (e.g., abutted against) the back portion 134 of the protective clip 110.

As shown in FIG. 9, the attachment feature 136 of the protective clip 110 for attaching a sweep strip thereto may have a length L that is selected to enable the attachment feature 136 to fit between the opposing lateral edge regions 184 of the panel 154A. For example, the attachment feature 136 may be positioned directly between the opposing lateral edge regions 184, such that a straight line drawn between the opposing lateral edge regions 184 passes through the attachment feature 136.

Again referring to FIG. 9, the base portion 112 of the protective clip 110 may cover at least a substantial portion of a bottom surface of the panel 154A. The guard portion 126 may extend along and cover a portion of the front side surface 182 of the panel 154A proximate the bottom surface thereof. The guard portion 126 may also extend at least partially around corners of the panel 154A at the hinge retainers 172 that extend along lateral sides of the panel 154A. Thus, the guard portion 126 may cover at least one of an edge and a corner defined by an intersection between the bottom surface of the panel 154A and the front side surface 182 of the panel 154A.

Referring to FIG. 10, the panel 154B is similar to the panel 154A of FIG. 8. However, the directions that ridges or protrusions 190B and 192B extend relative to the central plane C of the panel 154B of FIG. 10 are reversed when compared to the directions that the ridges or protrusions 190A and 192A extend relative to the central plane C of the panel 154A of FIG. 8. Thus, the panel 154B includes two ridges or protrusions 190B that extend from the central plane C of the panel 154B toward a front side of the panel 154B and one central ridge or protrusion 192B that extends toward a back side of the panel 154B. Such a reversed configuration may provide alternative options for attaching structural members (e.g., a structural member to suspend the panel 154B from the overhead track 162 (FIG. 1)) to the panel 154B when compared to the configuration of the panel 154A of FIG. 8.

As shown in FIG. 10, a distance D between the central ridge or protrusion 192B extending toward a back side of the panel 154B and an inner surface of an associated lateral edge portion 184 of the panel 154B, taken perpendicular to the central plane C of the panel 154B, may be related to the thickness T (FIG. 4) of the back portion 134 of the protective clip 110, essentially as described above with reference to FIG. 8.

The central ridge or protrusion 192B of FIG. 11 may have a hole therethrough corresponding to the hole 142 (FIGS. 2, 3, 6, and 7) of the protective clip 110 for attaching the protective clip 110 to the panel 154B with a fastener 194 (e.g., a rivet, a screw, a bolt, etc.), as described above with reference to FIG. 9.

Referring to FIG. 11, to assemble the protective clip 110 with the panel 154B, the tabs 144 of the protective clip 110 may be inserted into the channels 186 and coupled to (e.g., abutted against) respective internal surfaces of the lateral edge portions 184 of the panel 154B. The back portion 134 of the protective clip 110 may also be coupled to (e.g., be abutted against) the central ridge or protrusion 192B of the panel 154B. Thus, stability of the protective clip 110 relative to the panel 154B may be improved by mechanical interference between the protective clip 110 and the panel 154B, in essentially the same manner as described above with reference to FIG. 9.

Although the panels 154A and 154B have been described as each including three ridges or protrusions 190A, 190B, and 192A, 192B, the present disclosure is not so limited. For example, the protective clip 110 of the present disclosure may be assembled with a panel including any number of ridges or protrusions, such as a single ridge or protrusion extending toward a back of the panel with no other ridges or protrusions, or a plurality of ridges or protrusions. In some embodiments, the panel may not include any ridges or protrusions and may be substantially planar between opposing hinge retainers. If the panel is substantially planar, the back portion 134 of the protective clip 110 may be coupled to (e.g., abut against) substantially the entire back side surface 180 of the panel.

The panels 154A and 154B may be formed of any sufficiently rigid material, such as a metal material, a polymer material, a wood material, a composite material (e.g., fiberglass, woven fiber composite), or a combination thereof In some embodiments, as shown in FIGS. 8 through 11, the panels 154A and 154B may be formed of sheet metal that is bent into the desired shape. In other embodiments, the panels 154A and 154B may be formed by extrusion of a metal material or a polymer material, for example. One of ordinary skill in the art will be capable of selecting an appropriate technique for forming the panels 154A and 154B given a particular material, configuration, and/or application.

FIGS. 12 through 15 are shown and described below with reference to the panel 154B of FIGS. 10 and 11. Of course, one of ordinary skill in the art will be capable of applying the concepts described below to embodiments including the panel 154A of FIGS. 8 and 9, or any other panel falling within the scope of the present disclosure.

Figure 13:
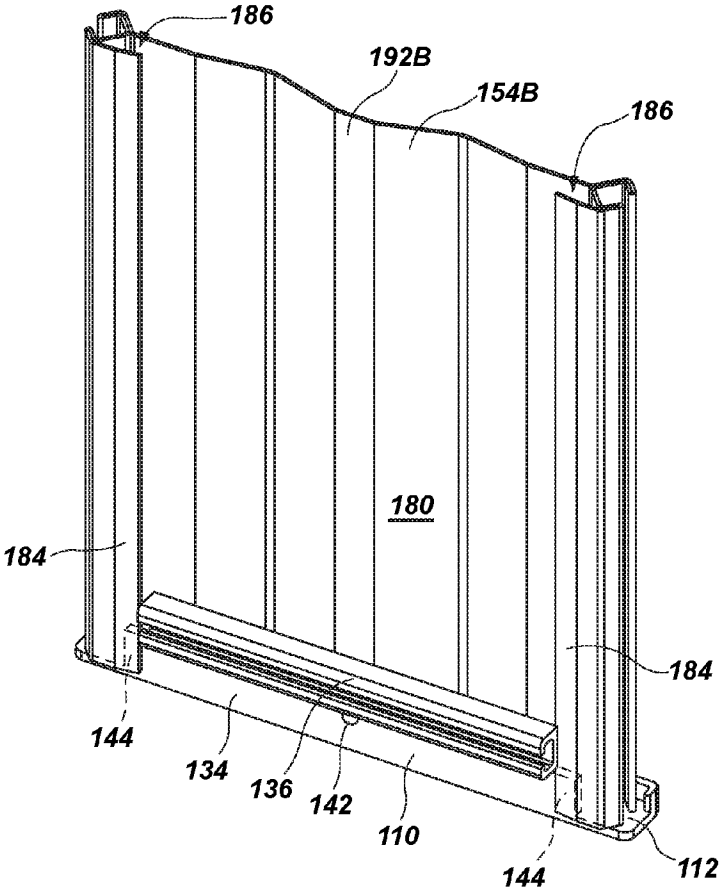
FIG. 13 is a perspective view of the protective clip and panel of FIG. 12 after being assembled.
Figure 12:
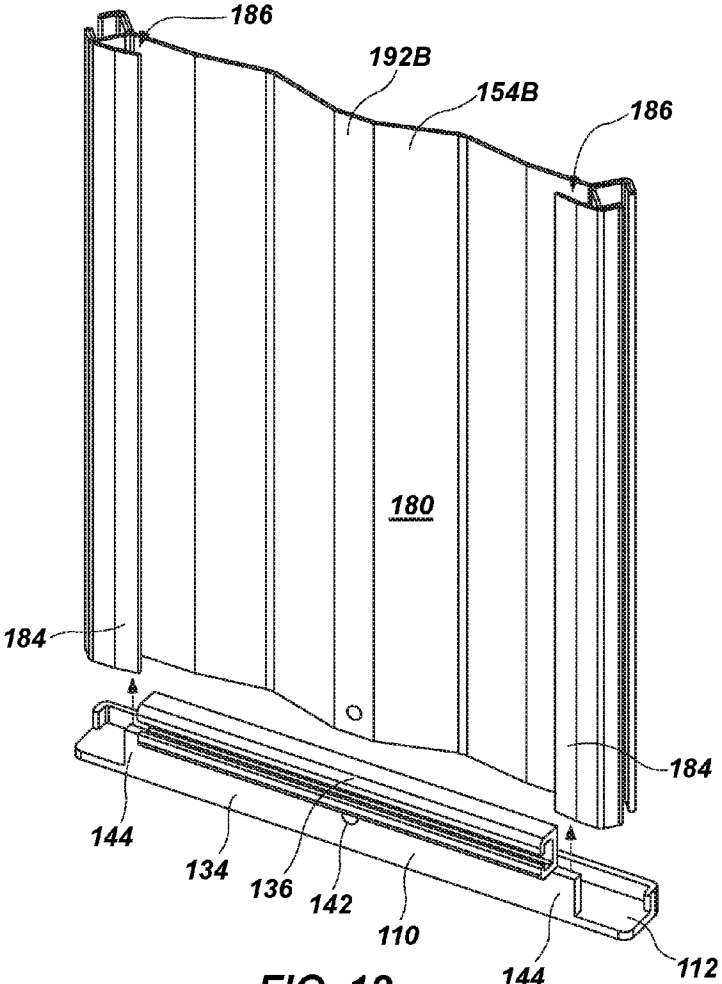
FIG. 12 is a perspective view of a protective clip and a panel showing how the protective clip and the panel may be assembled in accordance with embodiments of the present disclosure.

Referring to FIGS. 12 and 13, the protective clip 110 may be assembled with the panel 154B by positioning the protective clip 110 proximate a bottom surface of the panel 154B, and inserting the tabs 144 of the back portion 134 of the protective clip 110 into the channels 186 defined between the back side surface 180 and the lateral edge portions 184 of the panel 154B. The attachment feature 136 for attaching a sweep strip to the protective clip 110 may be positioned between the opposing lateral edge portions 184 of the panel 154B. The protective clip 110 may be positioned such that the base portion 112 of the protective clip 110 at least partially covers the bottom surface of the panel 154B. In some embodiments, the hole 142 of the protective clip 110 may be at least substantially aligned with a corresponding hole of the panel 154B, and a fastener may be positioned therethrough to attach the protective clip 110 with the panel 154B and to prevent the protective clip 110 from sliding off the panel 154B. As explained above, the back portion 134 of the protective clip 110 may be coupled to (e.g., abut against) the central ridge or protrusion 192B of the panel 154B.

The protective clips 110 of the present disclosure may offer some advantages over prior known protective clips or sweep clips. By way of example and not limitation, the protective clips 110 of the present disclosure may be more mechanically stable than prior known clips, relative to a corresponding panel 154, 154A, or 154B. Such improved stability may inhibit the protective clips 110 from tilting or otherwise being displaced relative to the panels, such as due to the protective clips 110 being subjected to forces from a person's foot or another object pressing against the protective clips, or to forces inherent from a sweep strip dragging across a floor as the movable partition is extended or retracted. Thus, the improved stability may reduce a risk of exposing sharp edges or corners that the protective clips 110 are meant to cover due to such tilting or other displacement. Additionally, the protective clips 110 of the present disclosure may exhibit improved stability even when only one fastener 194 is used to attach the protective clips 110 to corresponding panels 154, 154A, or 154B. Thus, the time and expense of using two or more fasteners to improve the stability may be reduced or avoided when the protective clips 110 of the present disclosure are used.

Figure 14:
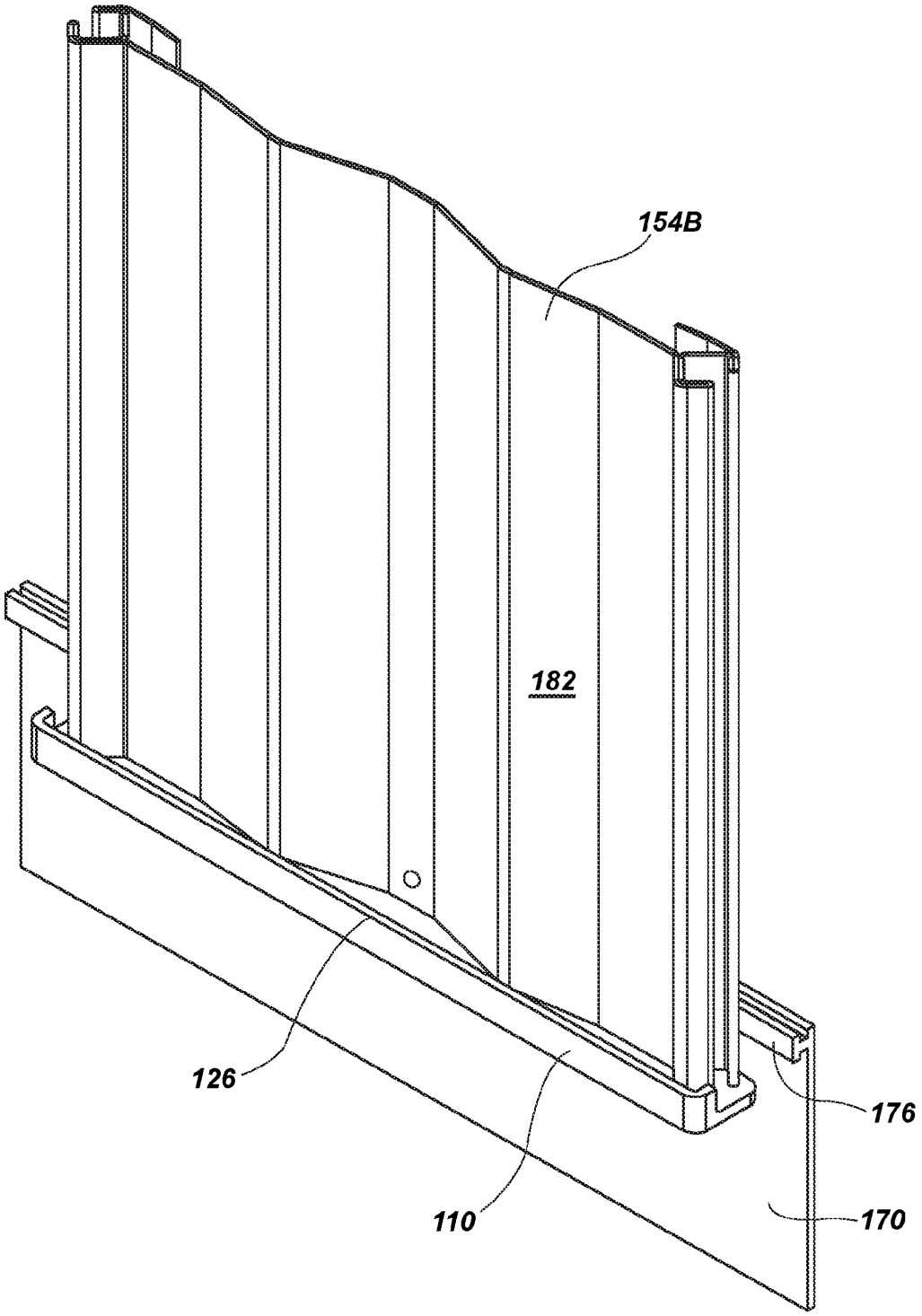
FIG. 14 is a perspective view of a front of the assembled panel and protective clip of FIG. 11, showing a sweep strip coupled to the protective clip.

FIG. 14 is a front perspective view of a portion of the movable partition 150 shown in FIG. 1 and illustrates a portion of a panel 154B (which may be used for any number of the panels 154 of FIG. 1), a sweep strip 170, and a protective clip 110 used to attach the sweep strip 170 to the panel 154B.

Referring to FIG. 14, after the protective clip 110 is assembled with the panel 154B, the guard portion 126 of the protective clip 110 may extend upward, along and adjacent the front side surface 182 of the panel 154B, and around outer corners of the panel 154B at a bottom thereof, to cover the bottom edge and outer corners of the panel 154B. Thus, the bottom edge and outer corners of the panel 154B are not exposed in a manner that would be likely to cut or otherwise significantly injure the foot or ankle of a person. A sweep strip 170 may be attached to the attachment feature 136 (FIGS. 2, 4, and 5) of the protective clip 110. For example, the sweep strip 170 may be provided with a complementary feature 176 such as a protrusion or "tongue" having a cross-sectional geometry substantially similar to the T-shaped geometry of the channel 140 (FIGS. 2 and 5) defined by the attachment feature 136 of the protective clip 110, such that the complementary feature 176 of the sweep strip 170 may be slid into the channel 140 to attach the sweep strip 170 to the protective clip 110. In other words, the complementary feature 176 of the sweep strip 170 may be engaged with the attachment feature 136 of the protective clip 110.

Figure 15:
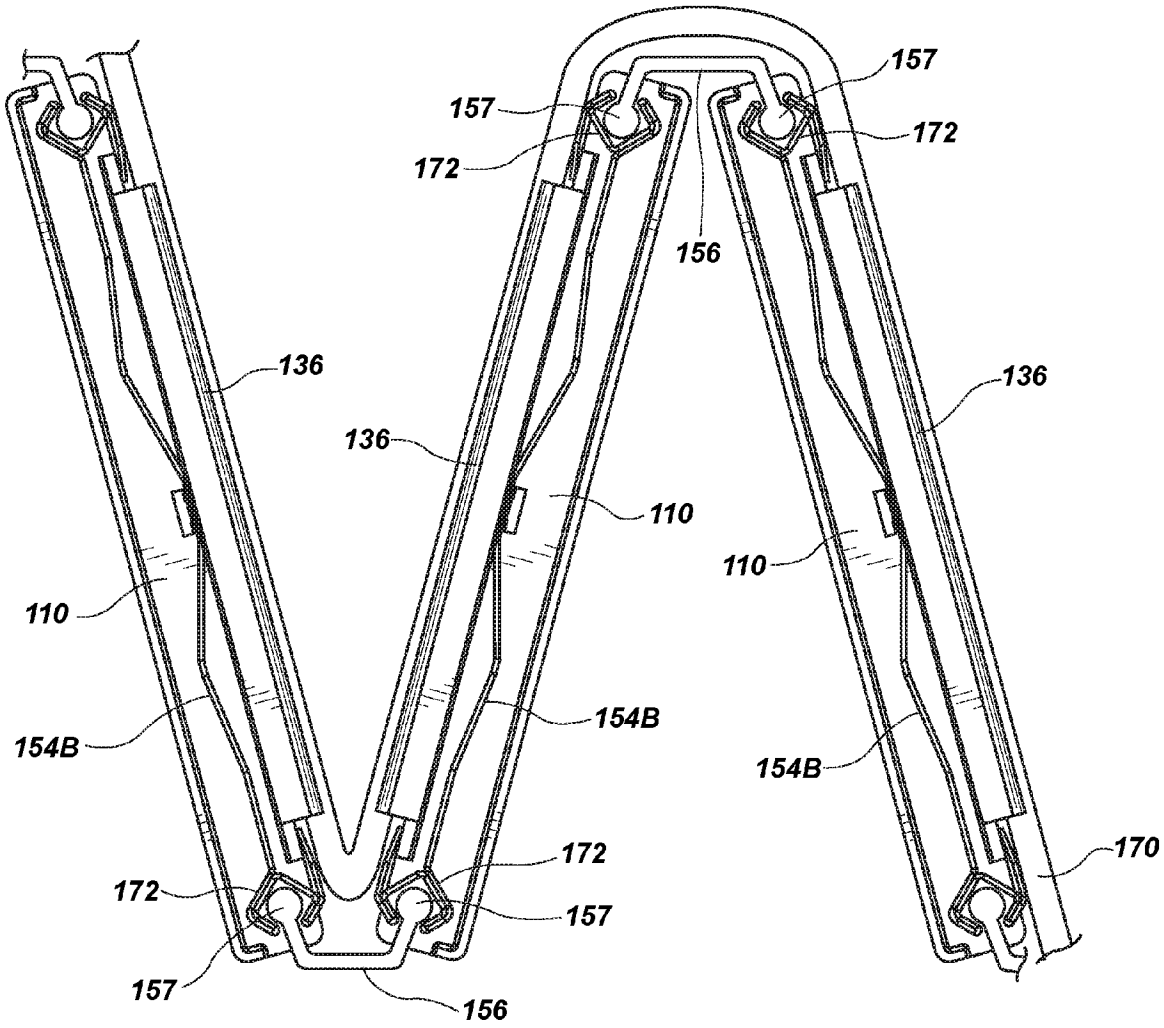
FIG. 15 is a top view of three adjacent panels with respective protective clips coupled thereto, each panel and respective protective clip similar to the assembled panel and protective clip of FIG. 11, showing hinge members and a sweep strip coupled thereto.

FIG. 15 is a top view of a portion of one side of the movable partition 150 of FIG. 1 and illustrates three adjacent panels 154B assembled with three respective protective clips 110, a sweep strip 170 attached to the protective clips 110, and hinge members 156 coupling adjacent panels 154B to each other.

As mentioned above with reference to the panels 154 of FIG. 1, the panels 154B may be connected to one another with flexible (e.g., polymeric) hinge members 156. As shown in FIG. 15, the hinge members 156 may have enlarged portions 157 (e.g., beads) along each lateral edge thereof. The enlarged portions 157 of the hinge members 156 may be inserted into respective hinge retainers 172 of adjacent panels 154B to hingedly couple the adjacent panels 154B to each other. The base portion 112 and the guard portion 126 (see FIG. 2) of the protective clip 110 may at least partially cover edges of these hinge retainers 172 at a lower end of the panel 154B. Thus, the guard portion 126 of the protective clip 110 may protect the feet of persons standing adjacent the partition 150 from injuries that could potentially be caused by exposed edges and corners at the lower end of the panel 154B. The guard portion 126, however, may be configured to provide clearance for the hinge members 156 when the hinge members 156 are disposed in the hinge retainers 172, in that the guard portion 126 does not extend all the way from the front of the protective clip 110 to the back of the protective clip 110.

In some embodiments, a single sweep strip 170 may be attached to more than one of the protective clips 110. For example, a single sweep strip 170 may be attached to two adjacent protective clips 110 of the movable partition 150 (FIG. 1), to three adjacent protective clips 110 of the movable partition 150, or to any number of adjacent protective clips 110 along a side of the movable partition 150. The sweep strip 170 may be attached to one or more of the protective clips 110 prior to or after the protective clips 110 are assembled with the panels 154B.

Figure 16:
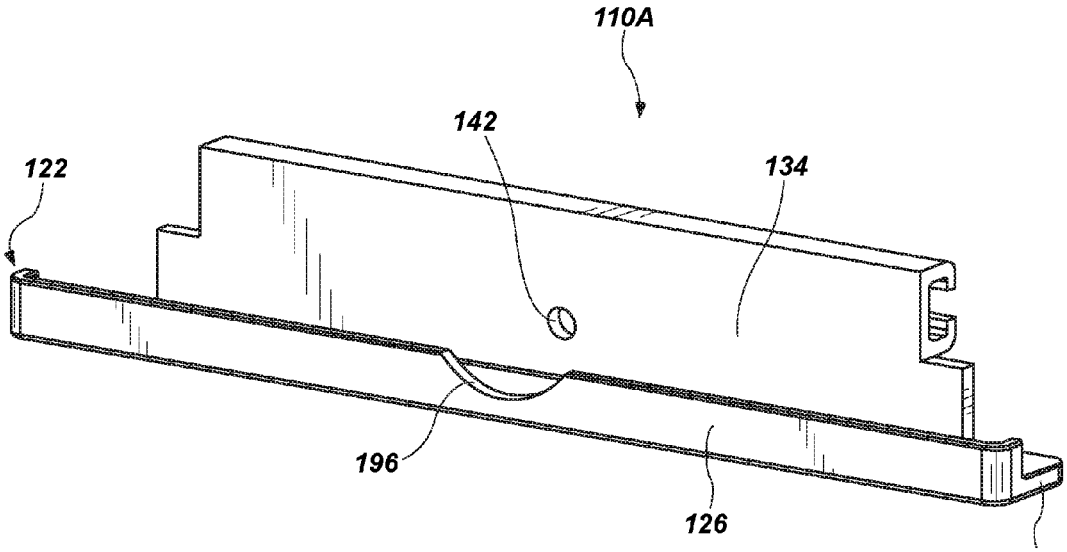
FIG. 16 is a front perspective view of a protective clip according to another embodiment of the present disclosure, which includes a recess in a guard portion thereof.

Referring to FIG. 16, another embodiment of a protective clip 110A of the present disclosure is shown. The protective clip 110A of FIG. 16 is similar to the protective clip 110 shown in FIGS. 2 through 7 in many aspects. However, the guard portion 126 of the protective clip 110A of FIG. 16 may include a recess 196 to provide increased access to the hole 142 formed in the back portion 134 of the protective clip 110A. By way of example and not limitation, the access may be provided to the hole 142 for: forming the hole 142, such as with a drill or a punch; installing a fastener (e.g., a rivet, a screw, a bolt) with an appropriate installation tool, such as with a rivet gun, a screwdriver, or a wrench; and/or removing the fastener with an appropriate removal tool, such as with a drill, screwdriver, or a punch. Thus, the recess 196 in the guard portion 126 may provide efficiency and ease in forming the protective clip 110A, in attaching the protective clip 110A to a panel, and/or in removing the protective clip 110A from a panel.

The recess 196 may have any shape and size sufficient to provide the access to the hole 142. For example, the recess 196 in the guard portion 126 may have a shape of a circular arc (as shown in FIG. 16), an elliptical arc, a rectangular cutout, a triangular cutout, or an irregular curve, for example. In some embodiments, the recess 196 may be at least substantially aligned with the hole 142 in a longitudinal direction of the protective clip 110A (i.e., along an axis taken from the first end side surface 122 to the second end side surface 124 of the protective clip 110A).

Figure 17:
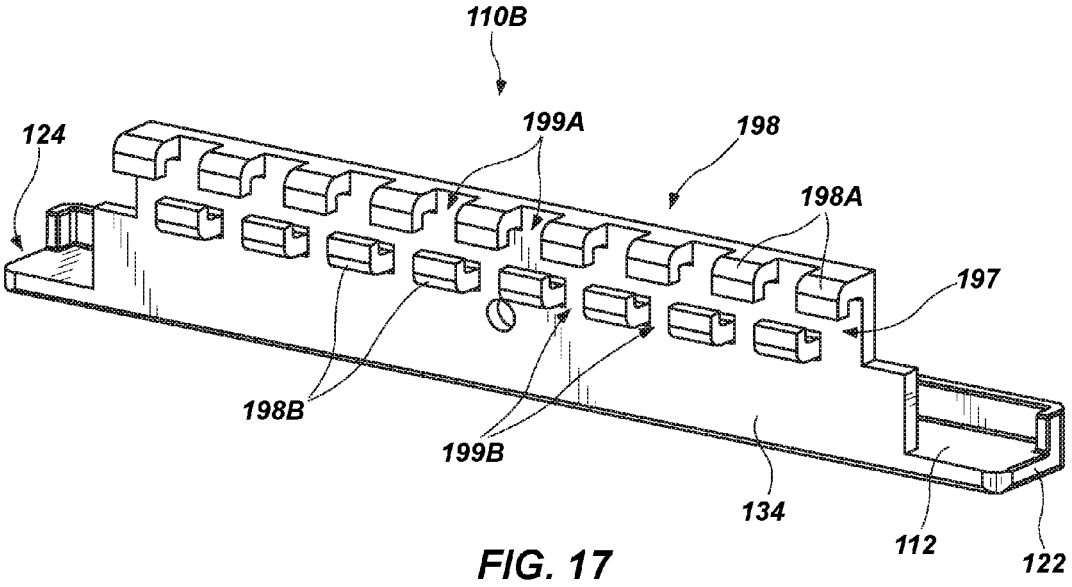
FIG. 17 is a back perspective view of a protective clip according to another embodiment of the present disclosure, which includes a discontinuous attachment feature for attaching a sweep strip thereto.

Referring to FIG. 17, another embodiment of a protective clip 110B of the present disclosure is shown. The protective clip 110B of FIG. 17 is similar to the protective clip 110 shown in FIGS. 2 through 7 in many aspects. However, the back portion 134 of the protective clip 110B of FIG. 17 may include a modified attachment feature 198 for attaching the sweep strip 170 (FIGS. 14 and 15) to the protective clip 110B. The modified attachment feature 198 may be discontinuous in a longitudinal direction of the protective clip 110B (i.e., along an axis taken from the first end side surface 122 to the second end side surface 124 of the protective clip 110B). For example, a plurality of upper portions 198A and a plurality of lower portions 198B of the modified attachment feature 198 may extend from the back portion 134 of the protective clip 110B to form a channel 197. The complementary feature 176 (FIG. 14) of the sweep strip 170 may be positioned within the channel 197 to attach the sweep strip 170 thereto. As shown in FIG. 17, the upper portions 198A of the modified attachment feature 198 may be separated by upper gaps 199A, and the lower portions 198B of the modified attachment feature 198 may be separated by lower gaps 199B. The upper portions 198A may be at least substantially aligned with the lower gaps 199B, and the lower portions 198B may be at least substantially aligned with the upper gaps 199A in a direction that the back portion 134 extends from the base portion 112 of the protective clip 110B.

The upper portions 198A and lower portions 198B of the modified attachment feature 198 may extend from the back portion 134 of the protective clip 110B in a direction generally perpendicular to the back portion 134, and toward a back of the protective clip 110B. A distal end of each of the upper portions 198A and the lower portions 198B distant from the back portion 134 may include a protrusion that extends in a direction generally parallel to the back portion 134 and toward the channel 197.

The modified attachment feature 198 of FIG. 17 may provide one or more advantages in manufacturing the protective clip 110B. For example, the modified attachment feature 198 may provide ease of manufacture and, therefore, reduced costs in embodiments in which the protective clip 110B is formed by injection molding. Furthermore, manufacturing productivity and throughput may be enhanced by enabling simplified tooling used to form the protective clip 110B.

Additional non-limiting example embodiments of the present disclosure are set forth below.

Embodiment 1: A panel assembly for a movable partition, comprising: a panel comprising a front side surface, a bottom surface, a back side surface, a lateral edge portion proximate each lateral side of the panel, and a channel defined between each lateral edge portion and the back side surface; and a protective clip covering at least a portion of the bottom surface of the panel, the protective clip comprising a base member coupled to the bottom surface of the panel and a back portion coupled to the back side surface of the panel, the back portion of the protective clip comprising two tabs, each tab positioned within a corresponding channel of the panel and coupled to a corresponding lateral edge portion of the panel.

Embodiment 2: The panel assembly of Embodiment 1, wherein the protective clip further comprises an attachment feature for attaching a sweep strip to the protective clip, the attachment feature positioned directly between the lateral edge portions of the panel.

Embodiment 3: The panel assembly of Embodiment 2, further comprising a sweep strip attached to the protective clip with the attachment feature of the protective clip.

Embodiment 4: The panel assembly of any one of Embodiments 1 through 3, wherein the protective clip is attached to the panel with no more than one fastener.

Embodiment 5: The panel assembly of any one of Embodiments 1 through 4, wherein the back portion of the protective clip is coupled to two protrusions of the panel extending from a central plane of the panel toward a back of the panel.

Embodiment 6: A movable partition, comprising: at least one panel, comprising: a front side surface; a back side surface; a bottom surface; and two lateral edge portions defining two opposing channels between the lateral edge portions and the back side surface; and at least one protective clip, comprising: a base portion; and a back portion protruding from the base portion, the back portion including a tab at each longitudinal end thereof, each tab sized to fit at least partially within a channel of the two opposing channels of the at least one panel; wherein the at least one protective clip is assembled with the at least one panel to at least partially cover the bottom surface of the at least one panel with the base portion, the back portion of the at least one protective clip is coupled to the back side surface of the at least one panel, and the tabs of the back portion of the at least one protective clip are inserted at least partially within the two opposing channels of the at least one panel.

Embodiment 7: The movable partition of Embodiment 6, wherein the at least one protective clip further comprises a guard portion protruding from the base portion, the guard portion covering at least a portion of a surface adjacent to the bottom surface of the at least one panel.

Embodiment 8: The movable partition of Embodiment 7, wherein the guard portion extends along a portion of the front side surface of the at least one panel and around two opposing corners of the at least one panel proximate the front side surface.

Embodiment 9: The movable partition of any one of Embodiments 6 through 8, wherein the back portion of the at least one protective clip comprises an attachment feature for attaching a sweep strip to the at least one protective clip.

Embodiment 10: The movable partition of Embodiment 9, further comprising a sweep strip attached to the attachment feature of the at least one protective clip.

Embodiment 11: The movable partition of Embodiment 10, wherein the at least one panel comprises at least two panels, the at least one protective clip comprises at least two protective clips assembled with the at least two panels, and the sweep strip is attached to at least two adjacent protective clips of the at least two protective clips.

Embodiment 12: The movable partition of Embodiment 10, wherein the sweep strip comprises a complementary feature engaged with the attachment feature of the protective clip.

Embodiment 13: The movable partition of any one of Embodiments 6 through 12, wherein each tab of the at least one protective clip is coupled to an inner surface of a respective lateral edge portion of the two lateral edge portions of a respective panel of the at least one panel.

Embodiment 14: The movable partition of any one of Embodiments 6 through 13, wherein the at least one panel comprises a plurality of panels hingedly coupled to each other, and the at least one protective clip comprises a plurality of protective clips assembled with respective panels of the plurality of panels.

Embodiment 15: The movable partition of any one of Embodiments 6 through 14, further comprising at least one fastener attaching the at least one protective clip to the at least one panel.

Embodiment 16: The movable partition of any one of Embodiments 6 through 15, wherein the at least one panel comprises at least one ridge extending from a central plane of the at least one panel toward a back side of the at least one panel, and the back portion of the at least one protective clip is coupled to the at least one ridge.

Embodiment 17: A method of attaching a protective clip to a panel of a movable partition, the method comprising: at least partially covering a bottom surface of the panel with a base portion of the protective clip; coupling a back portion of the protective clip to a back side surface of the panel, the back portion of the protective clip protruding from the base portion of the protective clip; positioning a tab extending from a longitudinal end of the back portion at least partially within a channel defined between the back side surface of the panel and a lateral edge portion of the panel; and positioning another tab extending from another longitudinal end of the back portion at least partially within another channel defined between the back side surface of the panel and another lateral edge portion of the panel.

Embodiment 18: The method of Embodiment 17, further comprising: aligning no more than one hole in the back portion of the protective clip with a corresponding hole in the panel; and positioning a fastener through the hole in the back portion of the protective clip and the corresponding hole in the panel.

Embodiment 19: The method of any one of Embodiments 17 and 18, further comprising: coupling the tab to an internal surface of the lateral edge portion of the panel; and coupling the another tab to an internal surface of the another lateral edge portion of the panel.

Embodiment 20: The method of any one of Embodiments 17 through 19, further comprising positioning a guard portion of the protective clip to cover at least one of an edge and a corner of the panel defined by an intersection between the bottom surface and a front side surface of the panel.

Embodiment 21: The method of any one of Embodiments 17 through 20, wherein coupling a back portion of the protective clip to a back side surface of the panel comprises abutting the back portion of the protective clip against at least one protrusion of the panel.

Embodiment 22: The method of any one of Embodiments 17 through 21, further comprising positioning a sweep attachment feature of the protective clip between the lateral edge portion and the another lateral edge portion of the panel.

The embodiments of the disclosure described above and illustrated in the accompanying drawing figures do not limit the scope of the invention, since these embodiments are merely examples of embodiments of the disclosure, which is defined by the appended claims and their legal equivalents. Any equivalent embodiments are intended to be within the scope of this disclosure. Indeed, various modifications of the present disclosure, in addition to those shown and described herein, such as alternative useful combinations of the elements described, may become apparent to those skilled in the art from the description. Such modifications and embodiments are also intended to fall within the scope of the appended claims and their legal equivalents.

What is claimed is:

1. A panel assembly for a movable partition, comprising:

a panel comprising a front side surface, a bottom surface, a top surface, a back side surface, a hinge retainer proximate each lateral side of the panel and extending at least partially along each lateral side from the bottom surface to the top surface, a flange of each hinge retainer extending along the back side surface toward a central region of the panel, and a channel defined between the flange of each hinge retainer and the back side surface of the panel; and a protective clip covering at least a portion of the bottom surface of the panel, the protective clip comprising a base member coupled to the bottom surface of the panel and a back portion coupled to the back side surface of the panel, the back portion of the protective clip comprising two tabs, each tab positioned within a corresponding channel of the panel between the flange of each hinge retainer and the back side surface of the panel and abutting against an inner surface of a corresponding flange of the hinge retainer, each tab separated from the back side surface of the panel within the corresponding channel.

2. The panel assembly of claim 1, wherein the back portion of the protective clip comprises an attachment feature for attaching a sweep strip to the protective clip.

3. The panel assembly of claim 2, wherein the attachment feature comprises a continuous attachment feature extending between the hinge retainers.

4. The panel assembly of claim 2, wherein the attachment feature comprises a discontinuous attachment feature including discontinuous upper portions and discontinuous lower portions defining a channel between the discontinuous upper portions and the discontinuous lower portions.

5. The panel assembly of claim 1, wherein the protective clip further comprises a guard portion protruding from a base portion, the guard portion covering at least a portion of a surface adjacent to the bottom surface of the panel.

6. The panel assembly of claim 5, wherein the guard portion extends to a height measured from a top major surface of the base portion of the protective clip of between about one sixteenth of an inch and about one quarter of an inch.

7. The panel assembly of claim 5, wherein the guard portion extends along a portion of the front side surface of the at least one panel and around two opposing corners of the at least one panel proximate the front side surface.

8. The panel assembly of claim 1, wherein each tab has a thickness of between about 0.05 inch and about 0.1 inch.

9. The panel assembly of claim 1, wherein each tab has a width taken parallel to a length of the base member of the protective clip of between about 0.1 inch and about 0.25 inch.

10. The panel assembly of claim 1, wherein the panel comprises at least one protrusion extending from a central plane of the panel toward the back side surface of the panel.

11. The panel assembly of claim 10, wherein the protective clip abuts against the at least one protrusion of the panel.

12. A movable partition system, comprising:

at least one panel, comprising:

a front side surface;

a back side surface opposite the front side surface;

a top surface;

a bottom surface opposite the top surface;

two hinge retainers, each hinge retainer proximate a lateral side of the at least one panel and extending at least partially along each lateral side from the bottom surface to the top surface;

two opposing flanges, wherein each hinge retainer of the two hinge retainers includes a respective flange of the two opposing flanges, each flange of the two opposing flanges extending along the back side surface toward a central region of the at least one panel, the two opposing flanges defining two opposing channels between the two opposing flanges and the back side surface of the at least one panel; and at least one protrusion extending from a central plane of the at least one panel toward at least one of the back side surface and the front side surface of the at least one panel; and at least one protective clip assembled with the at least one panel, comprising:

a base portion covering at least a portion of the bottom surface of the at least one panel; and a back portion protruding from the base portion, the back portion including a tab at each longitudinal end thereof, each tab sized to fit at least partially within a channel of the two opposing channels of the at least one panel, and each tab separated from the back side surface of the at least one panel within the respective channel of the two opposing channels, wherein the back portion abuts against the at least one protrusion of the at least one panel.

13. The movable partition system of claim 12, wherein the at least one panel comprises a plurality of panels hingedly coupled to each other, and wherein at least one protective clip is respectively assembled with each panel of the plurality of panels.

14. The movable partition system of claim 13, wherein a single sweep strip is attached to the protective clips respectively assembled with each panel of the plurality of panels.

15. The movable partition system of claim 12, wherein the at least one protrusion of the at least one panel comprises two protrusions, and wherein the back portion of the at least one protective clip is coupled to the two protrusions.

16. The movable partition system of claim 12, wherein the at least one protrusion comprises a single, central protrusion, and wherein the back portion of the at least one protective clip is coupled to the single, central protrusion.

17. A method of attaching a protective clip to a panel of a movable partition, the method comprising:

positioning a tab extending from a first longitudinal end of a back portion of the protective clip at least partially within a first channel defined between a back side surface of the panel and a first flange of a first hinge retainer of the panel, the first flange of the first hinge retainer extending along the back side surface toward a central region of the panel, and the tab separated from the back side surface of the panel within the first channel;

positioning another tab extending from a second longitudinal end of the back portion of the protective clip at least partially within a second channel defined between the back side surface of the panel and a second flange of a second hinge retainer of the panel, the second flange of the second hinge retainer extending along the back side surface toward the central region of the panel, and the other tab separated from the back side surface of the panel within the second channel; and abutting the back portion of the protective clip against at least one protrusion of the panel, the at least one protrusion extending from a central plane of the panel toward the back side surface of the panel.

18. The method of claim 17, further comprising coupling the back portion of the protective clip to the at least one protrusion of the panel with no more than one fastener.

19. The method of claim 17, wherein abutting the back portion of the protective clip against at least one protrusion of the panel comprises abutting the back portion of the protective clip against a single, central protrusion of the panel extending from the central plane toward the back side surface of the panel.

20. The method of claim 17, wherein abutting the back portion of the protective clip against at least one protrusion of the panel comprises abutting the back portion of the protective clip against two protrusions of the panel extending from the central plane of the panel toward the back side surface of the panel.

* * * * *